US006183262B1

(12) United States Patent
Tseng

(10) Patent No.: US 6,183,262 B1
(45) Date of Patent: Feb. 6, 2001

(54) MAGNETIC DRAWING BOARD STRUCTURE

(76) Inventor: Shao-Chien Tseng, No. 130 Sec. 2, Yang - Shin Rd., Yang-Mei, Taoyuan 326 (TW)

( * ) Notice: Under 35 U.S.C. 154(b), the term of this patent shall be extended for 0 days.

(21) Appl. No.: 09/394,131

(22) Filed: Sep. 10, 1999

(51) Int. Cl.[7] ..... B43L 1/00

(52) U.S. Cl. ..... 434/409; 434/410; 434/391; 434/422

(58) Field of Search ..... 434/162, 163, 434/168, 247, 258, 261, 391, 408, 409, 410, 411, 412, 413, 415, 422, 433

(56) References Cited

U.S. PATENT DOCUMENTS

| | | | | |
|---|---|---|---|---|
| Re. 25,363 | * | 4/1963 | Tate . | |
| 5,324,202 | * | 6/1994 | Meyers et al. | 434/410 |
| 5,335,942 | * | 8/1994 | Grinfas et al. | 283/74 |
| 5,820,385 | * | 10/1998 | Ohashi et al. | 434/409 |
| 5,997,309 | * | 12/1999 | Metheny et al. | 434/409 |

* cited by examiner

*Primary Examiner*—Jacob K. Ackun
*Assistant Examiner*—Bena B. Miller
(74) *Attorney, Agent, or Firm*—Pro-Techtor Inter-National Services

(57) ABSTRACT

A magnetic drawing board for color drawing used for children, it is comprised mainly of an encircled seat in the shape of a plate, plural set of iron powder of various colors and coarseness, a scraping plate and a magnetic pen. Wherein the nib of the magnetic pen can be changed with any of various shapes of nibs, the nib has therein a magnetic seat capable of changing orientations, attraction and repellent of magnetic poles thereon. The encircled seat is provided therein with a magnetic pad, magnetic force of the magnetic pad is smaller than that of the nib. The scraping plate is provided in the encircled seat which is provided at one edge thereof with a plurality of powder grooves, and a movable stop plate is pivotably provided above the powder grooves. And iron powder with various colors and coarseness is received in the powder grooves respectively. Screens are provided between every two of the powder grooves, meshes of the screens are arranged so that the size thereof varies from the largest to the smallest in a sequence. The magnetic pen is moved to attract the iron powder in the powder grooves and release it on the magnetic pad with its releasing amount and locations being under control to complete drawing. The scraping plate can scrape iron powder of various colors on the magnetic pad to the side where the collecting port is to store the iron powder in the powder grooves. Thus interest in color drawing with the magnetic drawing boards can be largely increased.

7 Claims, 5 Drawing Sheets

MAGNETIC DRAWING BOARD STRUCTURE

BACKGROUND OF THE INVENTION

1. Field of the Invention

The present invention is related to a magnetic drawing board for color drawing used for children, and especially to a drawing utensil for color drawing using iron powder of various colors as drawing pigment. Wherein, iron powder of various colors and coarseness is received in powder grooves of an encircled seat, and a magnetic pen is used to attract iron powder of desired colors and then is moved to a magnetic pad used as a drawing area in the encircled seat. And the iron powder is released with its releasing amount and locations being under control, so that an effect of making a colored drawing is obtained. A scraping plate is provided in the encircled seat to collect and scrape the iron powder attracted on the pad and in the drawing into the powder grooves for repeated using.

2. Description of the Prior Art

Conventional drawing utensils include generally coloring pens, crayons, ink, drawing boards and pigment etc. The conventional drawing utensils or articles are unsuitable for children, especially for children within the age of 3 years old to the school age. The children are in the age of enlightenment, the above mentioned conventional drawing utensils or articles are subjected to being put in the mouths or eaten by the children when they are provided for the children, especially those toxic utensils or articles such as crayons, or pigment etc. They shall be paid attention to in order not to be unintentionally eaten by the children.

There is a kind of magnetic drawing board specifically for children; it includes an encircled seat provided therein monochromatic iron powder and a scraping plate. And a magnetic pen is attached on the encircled seat for children to draw pictures in the encircled seat. The monochromatic iron powder is attracted on a film on the encircled seat, and trace of drawing can appear a pattern by drawing with the magnetic pen. When the pattern made with the monochromatic iron powder is to be deleted, it needs only to move the scraping plate, the monochromatic iron powder can then be scraped away and stored in the encircled seat. The monochromatic iron powder can be attracted with the magnetic pen and moved onto the film on the encircled seat at any time. Such conventional drawing board specifically for children has the advantages of capability of repeated using and preventing to be unintentionally eaten by children and thus has been very popular now. However, it has the defect of having only the ability of using monochromatic iron powder (in the original color of the iron powder, i.e., iron gray), and is monotonous in the effect made with the pattern or lines when in drawing. Children will not be interested in such kind of drawing in a long term. And the conventional drawing board is lack of an effect of providing children with a function of enlightenment in identifying and choosing colors. Therefore, it needs improvement.

SUMMARY OF THE INVENTION

In view of the above defect of the conventional magnetic drawing board in lacking of an effect of providing children with a chance of choosing colors for making colored drawings, the inventor of the present invention studied and developed a magnetic drawing board for colored drawings used for children. Which drawing board has an effect of providing children with a chance of choosing colors for making colored drawings and of recovering iron powder of various colors to the original positions thereof, and this is the object of the present invention.

To get the above object, the present invention is different from the conventional magnetic drawing board in the magnetic pen, the encircled seat and the iron powder practically used and has the following features:

The magnetic pen is capable of having its nib changed. Each nib has a magnetic seat of the electromagnetic converging style. And the magnetic pen has the ability of controlling the orientation of magnetic poles and the amount of magnetic attraction and repellent in favor of controlling the amount of attracted iron powder of various colors and coarseness, and in favor of controlling the amount and positions of releasing of the iron powder on a magnetic pad in the drawing area.

The encircled seat is made enclosed, a white magnetic pad is provided therein for color drawing. Magnetic force of the white magnetic pad is smaller than that of the magnetic nib, so that the magnetic pen with adjustable attraction force can be used to take suitable amount of iron powder of desired colors and bring it to suitable positions on the white magnetic pad to release gradually the iron powder on the magnetic nib. The white magnetic pad can attract the iron powder immediately in positions to make patterns or lines.

The encircled seat is provided at one edge thereof with a plurality of powder grooves for receiving therein iron powder of various colors and coarseness in favor of attracting and taking suitable amount of iron powder by the magnetic pen to the drawing area on the white magnetic pad for drawing.

The encircled seat is provided on the powder grooves with screens arranged from the one having the largest meshes to the one having the smallest meshes. The meshes are exactly coincident with the various coarseness of the iron powder. Thereby, the largest meshes can receive the iron powder with the largest coarseness, the middle meshes can receive the iron powder with the middle coarseness, and the smallest meshes can receive the iron powder with the smallest coarseness. In this sequence, the iron powder can be classified and put in its powder grooves with screens of suitable meshes rapidly for storing.

The present invention will be apparent after reading the detailed description of the preferred embodiment thereof in reference to the accompanying drawings.

DETAILED DESCRIPTION OF THE PREFERRED EMBODIMENT

Figure 1:
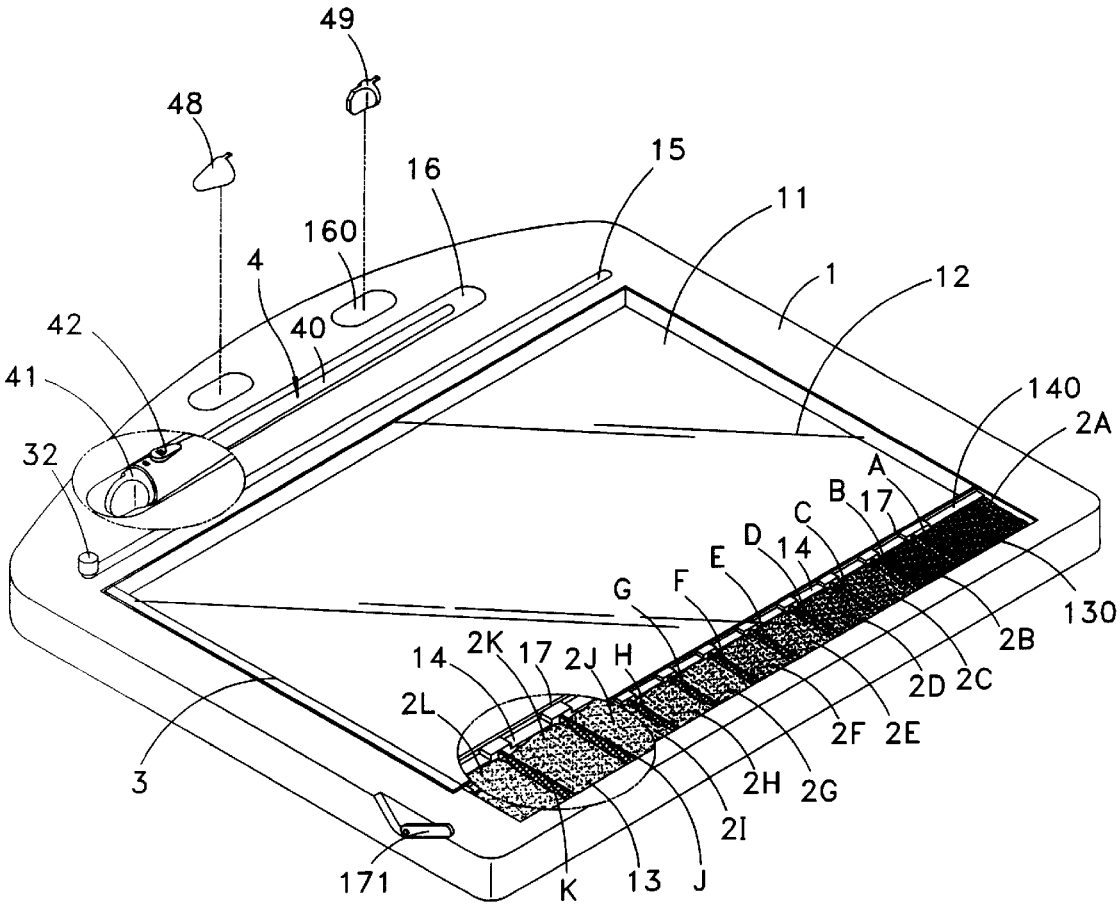
FIG. 1 is a perspective view showing the magnetic drawing board for color drawing of the present invention.

Referring to FIG. 1, the present invention provides a magnetic drawing board for color drawings used for children. It is comprised mainly of an encircled seat 1 which is in the shape of a plate, plural set of iron powder of various colors and coarseness (2A, 2B, 2C, 2D, 2E, 2F, 2G, 2H, 2I, 2J, 2K, 2L), a scraping plate 3 and a magnetic pen 4.

Figure 2:
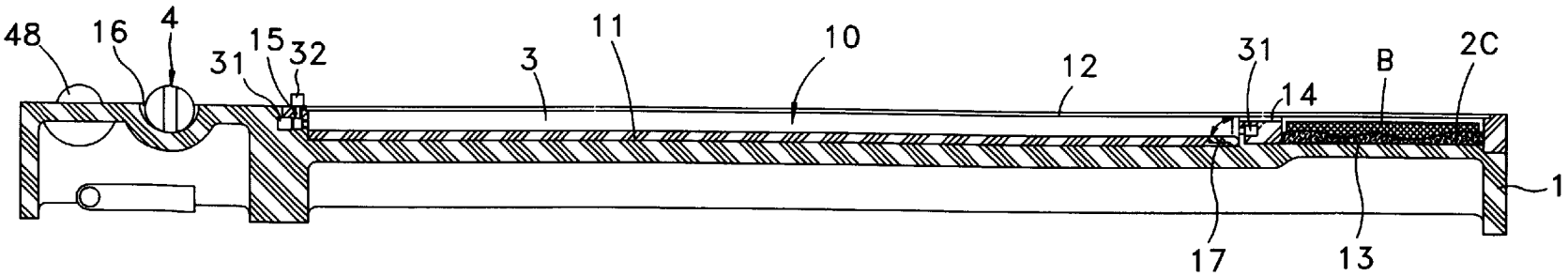
FIG. 2 is a sectional view showing the magnetic drawing board for color drawing of the present invention.
Figure 4:
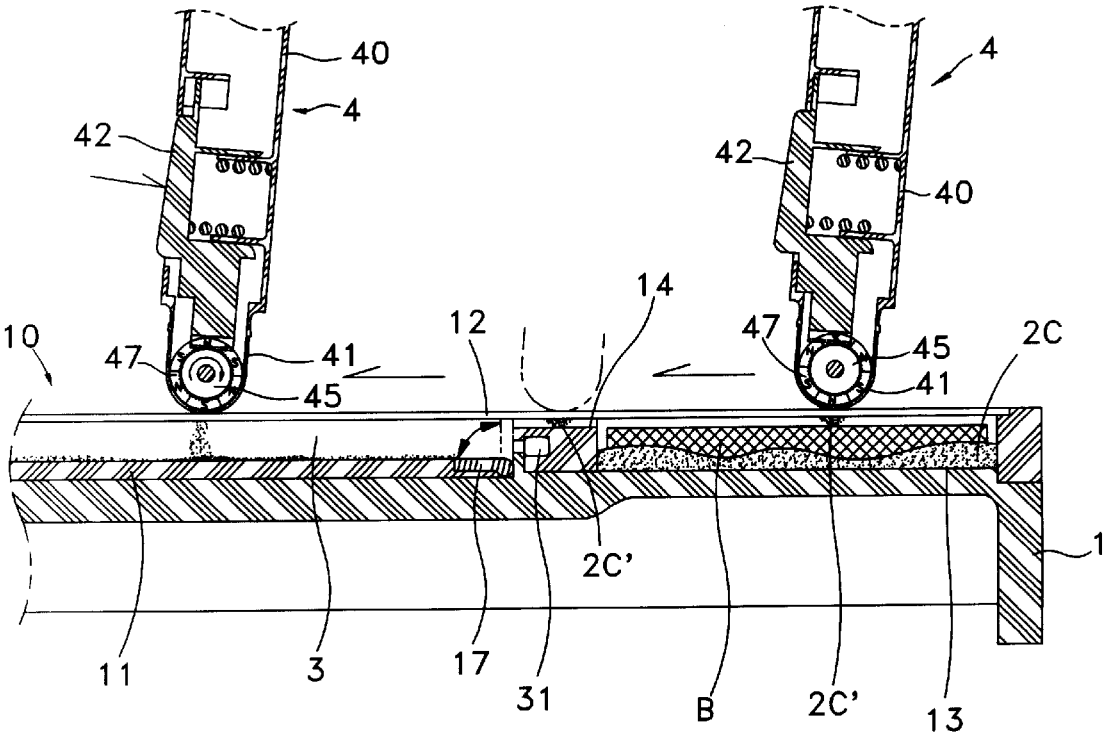
FIG. 4 is a partially enlarged sectional view showing the operation of the magnetic pen of the present invention in attracting iron powder for drawing.

Wherein, the encircled seat 1 is provided therein with a magnetic pad 11 for drawing and coloring thereon. The surface of the magnetic pad 11 is preferably made white. The magnetic pad 11 has N magnetic poles and S magnetic poles densely allocated therein. The magnetic force of these magnetic poles is smaller than that of a magnetic seat 47 in the nib 41 of the magnetic pen 4. A transparent viewing plate 12 is provided on the encircled seat 1 and kept a space 10 from the magnetic pad 11 allowing effective magnetic attraction. The transparent viewing plate 12 is used as a base surface for pushing to and fro of the nib 41 of the magnetic pen 4 thereon as is the situation described hereinafter (as shown in FIGS. 2 and 4). And the encircled seat 1 is provided at one edge thereof with a plurality of powder grooves 13. Wherein, the first powder groove 130 has a larger volume and a larger collecting port 140, and the rest of the powder grooves 13 each has an adequate volume and a port 14. A movable stop plate 17 is pivotably provided above the collecting port 140 and the ports 14. The movable stop plate 17 is pivoted by a manipulating rod 171 pivotably provided on and exposed to the top of the encircled seat 1 (as shown in FIG. 1). When the movable stop plate 17 is pivoted upwardly, they can close the collecting port 140 and the ports 14 of the first powder groove 130 and the rest of the powder grooves 13 respectively (as shown in FIG. 2). Or when it is pivoted down, the collecting port 140 and the ports 14 of the first powder groove 130 and the rest of the powder grooves 13 respectively are together opened to communicate with the space 10 allowing effective magnetic attraction (as shown in FIG. 4). Screens (A, B, C, D, E, F, G, H, I, J, K) are provided for the first powder groove 130 and each of the rest of the powder grooves 13 respectively, meshes of the screens are arranged like this: meshes for screen A are the largest ones, the size of the meshes gets smaller and smaller along the screens in the sequence of (A, B, C, D, E, F, G, H, I, J, K), and meshes for the screen K are the smallest ones. And iron powder (2A, 2B, 2C, 2D, 2E, 2F, 2G, 2H, 2I, 2J, 2K, 2L) with various colors and coarseness is received in the first powder groove 130 and each of the rest of the powder grooves 13 respectively (as shown in FIG. 1).

The scraping plate 3 is provided in the space 10 of the encircled seat 1 (as shown in FIG. 1) and is provided on both ends thereof with a roller 31 placed in a slide slot 15 on the encircled seat 1 (as shown in FIG. 2). One end of the scraping plate 3 is provided with a manipulating button 32 rendering the scraping plate 3 to be able to scrape iron powder of various colors on the magnetic pad 11 and in the space 10 allowing effective magnetic attraction.

A pen receiving slot 16 and a plurality of nib receiving slots 160 are provided at suitable locations on the encircled seat 1 to receive the magnetic pen 4 and a plurality of nibs 41 with different shapes (as shown in FIG. 1).

Figure 3:
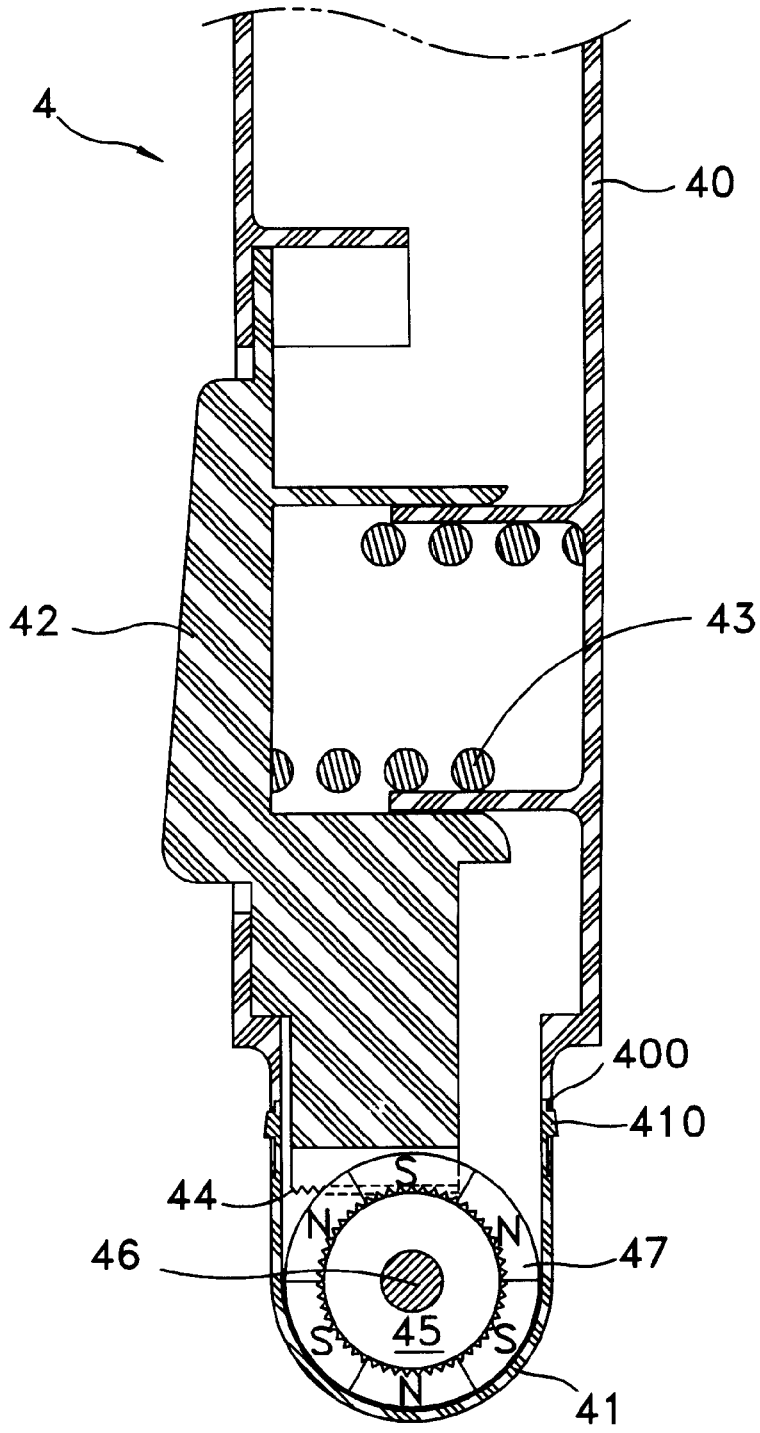
FIG. 3 is a partially enlarged sectional view of a magnetic pen of the present invention.

The magnetic pen 4 has two parts, the pen body 40 and the nib 41. The pen body 40 is provided on the opening mouth thereof with an engaging seat 400, while the nib 41 is provided with an engaging portion 410 which is assembled on the engaging seat 400, so that the nib 41 can be mounted on the pen body 40 (as shown in FIG. 3). The pen body 40 is provided with a press button 42 having a helical compression spring 43 therein and having a toothed portion 44 on one end thereof (as shown in FIG. 3). The nib 41 is in the shape of a curved nib 41, a conical nib 48 or a nib 49 with a polygonal periphery etc. (as shown in FIG. 1). Each nib 41 is provided with a rotation axle 46 for mounting thereon a toothed wheel 45 and another magnetic seat 47 (as shown in FIG. 3). The magnetic seat 47 is in the shape of a curved, a conical or a polygonal seat just like the shape of the nib 41. In fact, the magnetic seat 47 is hidden in the nib 41. The magnetic seat 47 is comprised of a plurality of N magnetic poles and S magnetic poles alternatively arranged to form a circle (as shown in FIG. 3). Therefore, when the pen body 40 and the nib 41 are combined with each other, the toothed portion 44 on one end of press button 42 of the pen body 40 can be engaged with the toothed wheel 45 in the nib 41. So that when a user gradually press the press button 42, the toothed wheel 45 can make the magnetic seat 47 rotate to change distribution of the N magnetic poles and S magnetic poles on the nib 41 to render the N magnetic poles or the S magnetic poles to get away from the front of the nib 41. Thus amount of attraction or repellent of the nib 41 can be controlled.

As in the situation shown in FIG. 4, when a child holds the magnetic pen 4, he can make an N magnetic pole in the magnetic seat 47 face down without pressing the press button 42 of the pen body 40 (as shown in FIG. 3). Then he can choose iron powder with a desired color and move the magnetic pen 4 to the position above a powder groove 13 having the chosen color, open the movable stop plate 17 and make contact of the nib 41 with the transparent viewing plate 12 on the powder groove 13 to attract the colored iron powder 2C' (separated from the colored iron powder 2A–2L and is marked here with 2C') attached to the bottom of the transparent viewing plate 12. And then he can move the magnetic pen 4 clinging to the transparent viewing plate 12 to move together therewith the colored iron powder 2C' through the port 14 of the powder groove 13. The colored iron powder 2C' attached to the nib 41 is moved to the space 10 allowing effective magnetic attraction and is moved in pursuance of the paths of or the areas for drawing. And then slowly press down the press button 42 to rotate an N magnetic pole in the magnetic seat 47 gradually away from the front of the nib 41, and to render an S magnetic pole neighboring the N magnetic pole in the magnetic seat 47 to get close to the front of the nib 41 gradually. By control of attraction or repellent of the colored iron powder 2C' by means of the different magnetic poles of the nib 41, pen drawing effect in controlling releasing amount of pigment can be achieved just like the case of a writing brush or water color painting brush. Thereby, the colored iron powder 2C' can be released from the nib 41 in the desired drawing areas and paths in the space 10 allowing effective magnetic attraction. The released iron powder 2C' can be rapidly absorbed in the drawing areas and paths on the magnetic pad 11 to form the contour and pattern of a colored drawing.

In order to effectively control the releasing amount of the colored iron powder 2C' from the nib 41, in addition to pressing the press button 42 of the magnetic pen 4 to rotate the N and S magnetic poles in the magnetic seat 47 to change the amount of attraction or repellent on the iron powder 2C', a technique of manipulating raising and lowering of the magnetic pen 4 above the transparent viewing plate 12 can also control amount of releasing of the colored iron powder 2C' for drawing. This is because, when a user gradually raises the magnetic pen 4 above the transparent viewing plate 12, the amount of attraction or repellent on the iron powder 2C' beneath the transparent viewing plate 12 exerted by the magnetic seat 47 in the nib 41 will be gradually reduced. So that suitable amount of releasing of the iron powder 2C' on the magnetic pad 11 for drawing can be obtained under control.

Figure 5:
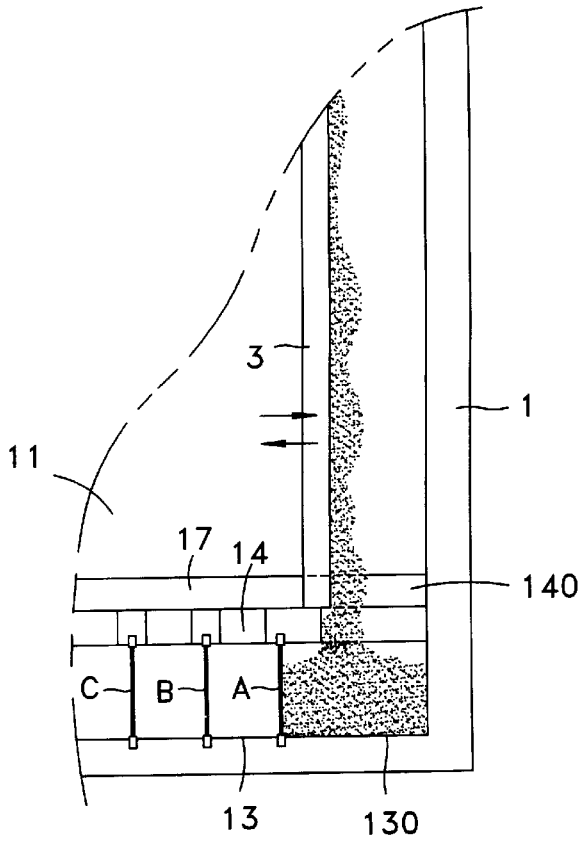
FIG. 5 is a partially enlarged schematic view showing the operation of a scraping plate of the present invention in collecting iron powder of various colors by scraping into the first powder groove.
Figure 6:
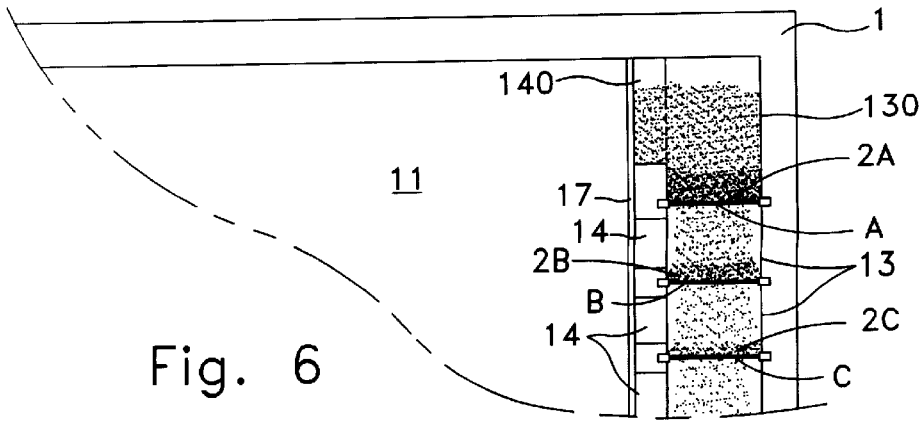
FIG. 6 is a partially enlarged schematic view showing the operation of screens of the present invention in screening iron powder of various colors.

After the magnetic pen 4 is moved to and fro above the transparent viewing plate 12 to attract the iron powder beneath the transparent viewing plate 12 to desired positions and release it on the magnetic pad 11 to complete drawing, and when the drawing on the magnetic pad 11 is to be deleted, simply move by hand the manipulating button 32 on the encircled seat 1 to drive the scraping plate 3 to scrape iron powder of various colors on the magnetic pad 11 to the side where the collecting port 140 is (as shown in FIG. 5), then close the movable stop plate 17 to close the collecting port 140 and the ports 14 of the first powder groove 130 and the rest of the powder grooves 13 respectively, and shake the encircled seat 1 to tip the iron powder collected by scraping into the collecting port 140 and the ports 14 of the first powder groove 130 and the rest of the powder grooves 13 respectively. The coarsest iron powder is screened with the screen A having the largest meshes and falls into the first powder groove 130. While the second coarsest iron powder in the rest iron powder is moved into the next powder groove 13 after screening of the next screen B (as shown in FIG. 6), and so forth. So that the iron powder (2A, 2B, 2C, 2D, 2E, 2F, 2G, 2H, 2I, 2J, 2K, 2L) with various colors and coarseness can be screened through the meshes in the sequence of A, B, C, D, E, F, G, H, I, J, K and stored in their respective powder grooves 130 and 13. Hence the iron powder with various colors and coarseness can be recovered, and interest and ability of children in color drawing with the magnetic drawing boards can be largely increased.

Having thus described my invention, what I claim as new and desire to be secured by Letters Patent of the United States are:

1. A magnetic drawing board comprising:

an encircled seat, a plurality of iron powders, said iron powders each have different colors and coarseness, a scraping plate, a plurality of nibs and a magnetic pen; wherein said encircled seat comprises a magnetic pad, said magnetic pad is provided with a transparent viewing plate spaced from the magnetic pad, said scraping plate is positioned between said magnetic pad and said viewing plate, a pen receiving slot and a plurality of nib receiving slots are provided on said encircled seat to receive said magnetic pen and said plurality of nibs, said magnetic pen comprises a pen body and a nib, said pen body is provided with an engaging seat, and each of said nibs are provided with an engaging portion which is received in said engaging seat when each of said nibs is mounted on said pen body; and wherein said encircled seat is provided at one edge thereof with a plurality of powder grooves, screens are provided between each adjacent pair of said powder grooves, meshes of said screens are arranged so that sizes of said meshes varies from largest to smallest in sequence, and said iron powders are each received in a corresponding one of said powder grooves through said meshes according to a coarseness of each of said iron powders, a first one of said powder grooves is associated with a largest mesh and has a large collecting port, remaining ones of said powder grooves each has a port, a movable stop plate is pivotably positioned above said collecting port and said ports, said movable stop plate is pivoted by a manipulating rod pivotably positioned on a top of said encircled seat to control opening and closing of said collecting port and said ports of said powder grooves, said pen body includes a press button with a toothed portion on one end, said nib is provided with a rotation axle for mounting a toothed wheel and a magnetic seat comprised of a plurality of north magnetic poles and south magnetic poles alternatively arranged to form a circle, wherein depressing said press button causes said toothed wheel to rotate said magnetic seat so as to alter an amount of attracting or repelling forces of said north magnetic poles and south magnetic poles on said nib; such that when said nib of said magnetic pen is placed on said transparent viewing plate above a powder groove containing a desired iron powder to attract iron powder onto said nib, said magnetic pen is then moved along said transparent viewing plate so as to pull said desired iron powder out of said powder groove onto said magnetic pad of said encircled seat beneath said magnetic pen, said engaging seat in said pen body being press-controlled to vary displacement of said north and south magnetic poles, such that in conjunction with raising and lowering said magnetic pen, a user releases said desired iron powder at desired positions and in desired amounts, said desired iron powder is rapidly absorbed in drawing areas and paths on said magnetic pad to form contours and patterns of a colored drawing, and following construction of said colored drawing, the user uses said scraping plate to scrape said iron powders of various colors from said magnetic pad into said powder grooves, said iron powders are screened by said screens having various sizes of meshes to separate said iron powders by coarseness, such that each of said iron powders falls into said corresponding one of said powder grooves, so that said iron powders are recovered and can be used repeatedly.

2. The magnetic drawing board as claimed in claim 1, wherein:

an attraction force of said magnetic pad is smaller than that of said magnetic seat in said nib.

3. The magnetic drawing board as claimed in claim 1, wherein, said first one of said powder grooves has a larger volume for receiving said iron powder than said remaining ones of said powder grooves.

4. The magnetic drawing board as claimed in claim 1, wherein:

said movable stop plate includes an opening used to convey said iron powder to said collecting port of said first one of said powder grooves and said ports of said remaining ones of said powder grooves.

5. The magnetic drawing board as claimed in claim 1, wherein:

at least one of said nibs is curved.

6. The magnetic drawing board as claimed in claim 1, wherein:

at least one of said nibs is conical.

7. The magnetic drawing board as claimed in claim 1, wherein:

at least one of said nibs is polygonal.

* * * * *